United States Patent [19]

Ogura

[11] Patent Number: 4,761,674

[45] Date of Patent: Aug. 2, 1988

[54] FULL WASTE TONER CONTAINER DETECTOR

[75] Inventor: Mitsuru Ogura, Nara, Japan

[73] Assignee: Sharp Kabushiki Kaisha, Osaka, Japan

[21] Appl. No.: 945,520

[22] Filed: Dec. 23, 1986

[30] Foreign Application Priority Data

Dec. 27, 1986 [JP] Japan ..... 60-297307

[51] Int. Cl.[4] ..... G03G 21/00

[52] U.S. Cl. ..... 355/15

[58] Field of Search ..... 355/3 DD, 15; 118/652, 118/653

[56] References Cited

U.S. PATENT DOCUMENTS 3,966,316 6/1976 Pfeifer ..... 355/15 X
4,412,736 1/1983 Sakamoto ..... 355/15

FOREIGN PATENT DOCUMENTS 56-165178 12/1981 Japan ..... 118/652
60-165679 8/1985 Japan ..... 355/15
60-200277 10/1985 Japan ..... 355/15
1318632 5/1973 United Kingdom .
2106835 4/1983 United Kingdom .
2152435 7/1985 United Kingdom .

OTHER PUBLICATIONS

Xerox Disclosure Journal, vol. 8, No. 5, Sep./Oct. 1983, "Flexible Cleaner Seal", p. 431-McCarroll.

*Primary Examiner*—A. T. Grimley
*Assistant Examiner*—J. Pendegrass
*Attorney, Agent, or Firm*—Birch, Stewart, Kolasch & Birch

[57] ABSTRACT

A full waste toner container detector system which includes a waste toner container for storing waste toner collected from a photoreceptor surface, a flexible film member which projects into the container when the container is not filled up with waste toner and projects outwardly from the container due to the waste toner pressure when the container is full of waste toner, a reflection plate mounted on the external surface of the flexible member, a light source for irradiating the reflection plate, and a sensor provided in such a position as to receive light reflected by the reflection plate when the flexible member projects outwardly from the container.

6 Claims, 4 Drawing Sheets

FULL WASTE TONER CONTAINER DETECTOR

BACKGROUND OF THE INVENTION

The present invention relates to a detector for detecting a waste toner container filled with waste toner collected from the photoreceptor surface.

A number of detectors for detecting full waste toner containers have been proposed. None of them, however, detect the full waste toner container accurately.

SUMMARY OF THE INVENTION

The object of the present invention is to provide a full waste toner container detector which comprises a flexible film member projecting into the container when the container is not filled with waste toner and projecting outwardly from the container when it becomes full, a reflection plate provided on the outer surface of the flexible member to multiply the change of the flexible member caused by waste toner pressure, and an optical sensor for detecting the change, thereby achieving an accurate detection of a full waste toner container.

The present invention comprises a flexible film member provided on a waste toner container for storing waste toner collected from the photoreceptor surface, which member projects into the container when the container is not full and caused to project outwardly from the container due to the waste toner pressure when the container is filled with waste toner, a reflection plate mounted on the external surface of the flexible member, a light source for irradiating the reflection plate, and a sensor installed in such a position as to receive light reflected by the reflection plate when the flexible member projects outwardly from the container.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 5:
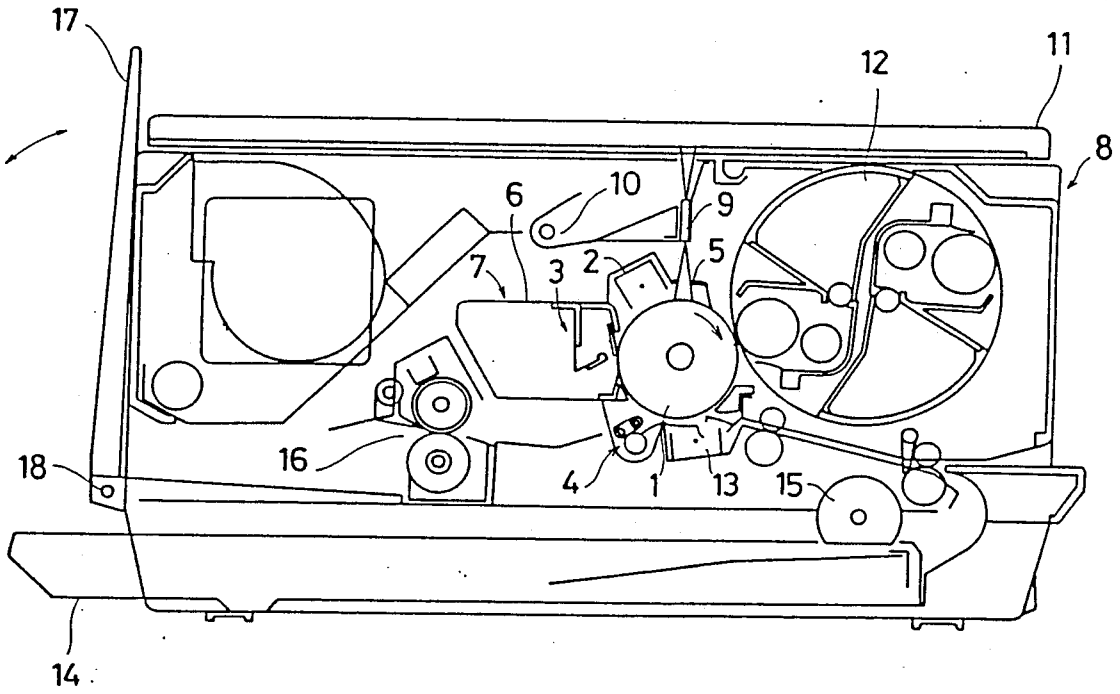
FIG. 5 is a schematic sectional construction view of the copying machine.

FIG. 5 is a schematic sectional construction drawing of a copying machine related to the present invention. A photoreceptor 1 is mounted integrally with a surrounding electric charger 2, cleaner unit 3, separator unit 4 and light exposure opening (slit) 5, in a housing 6, thus forming a cartridge 7. The cartridge 7 is detachable from the copying machine proper 8. The cartridge 7 can be set in the copying machine proper 8 simply by opening the front panel of the copying machine proper 8 and inserting the cartridge 7 perpendicular to a copy paper. The cartridge 7 can be dismounted by pulling it to the operator side. A rail guide mechanism (not shown) assists in mounting or dismounting the cartridge 7 in or from the copying machine proper 8.

A convergent light transmitter 9 mounted over the light exposure slit 5 and a light source 10 provided to the left of the transmitter 9 constitute the optical system. A document placed on a manuscript rest 11 is scanned by a light beam from the light source 10 while the manuscript rest 11 is moving horizontally. The light reflected by the document surface is transmitted through the convergent light transmitter 9 for projection on the photoreceptor 1. The photoreceptor 1 rotates in the direction of the arrow of FIG. 5. After being uniformly charged by the electric charger 2, the photoreceptor 1 is exposed to the light coming through the light exposure slit 5. An image is developed by a developing unit 12 and transferred onto a copy paper by a transference charger 13. The copy paper is fed from a copy paper cassette 14 by a paper feed roller 15 which is mounted at the bottom of the copying machine proper 8. The copy paper, on which the image on the photoreceptor 1 has been transferred, is separated from the photoreceptor 1 by a separator unit 4 and conveyed to fixing rollers 16 where the image is fixed onto the copy paper. Then, the copy paper is discharged to a tray 17. The tray 17 is rotatable about a pin 18 in the direction of the arrow of FIG. 5. During the copying operation, the tray 17, which is folded as shown, is rotated counterclockwise around the pin 18 and set in the position virtually parallel to the copying machine proper 8. The developing unit 12 has two developing sections either of which is selected by rotation.

Figure 1:
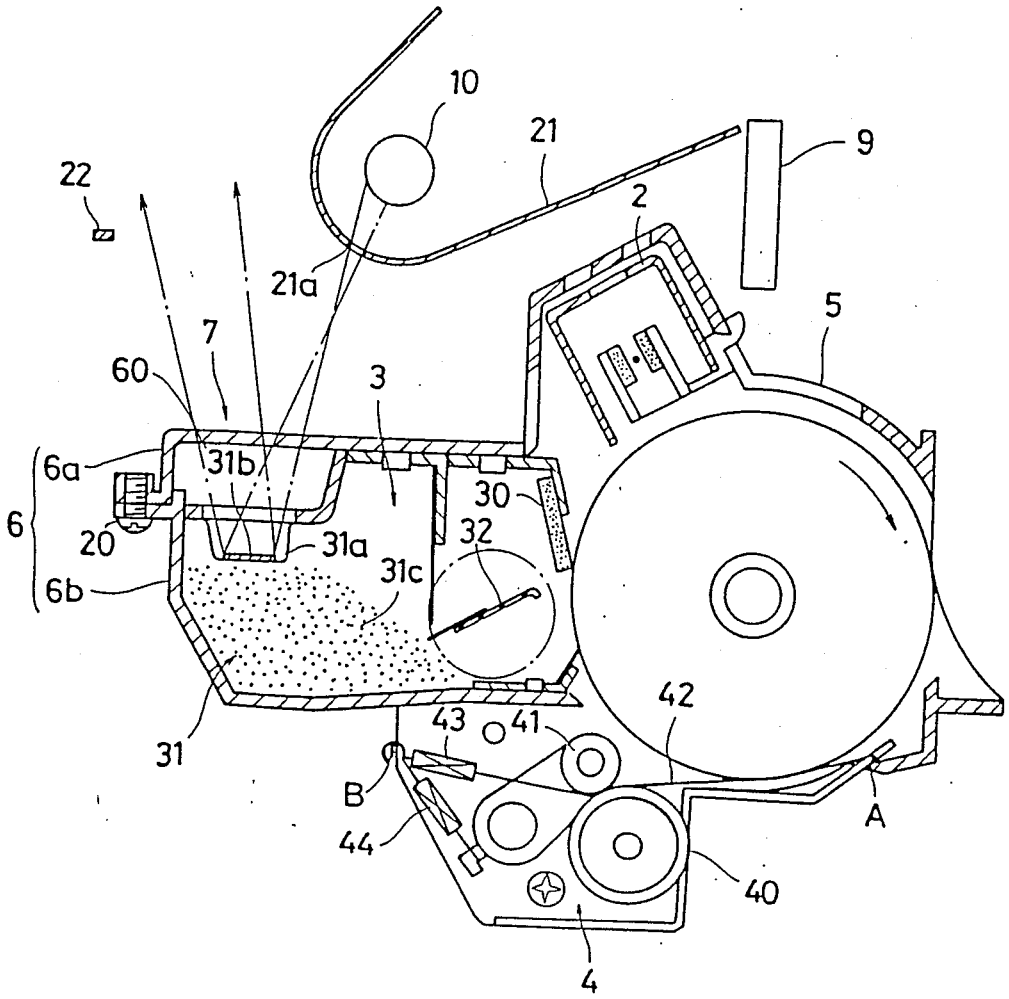
FIGS. 1 and 2 are sectional views of the cartridge in a copying machine as an embodiment of a full waste toner container detector of the present invention, with the container in a partially filled up condition and with the container filled up, respectively.

FIG. 1 is a sectional view of the cartridge 7.

The housing 6 comprises an upper frame **6*a* and a lower frame 6*b* which are joined by a machine screw 20. The rotary shaft of the photoreceptor 1, the electric charger 2, the separator unit 4 and the cleaner unit 3 are mounted integrally with the housing 6. The cleaner unit 3 comprises a blade 30 for scraping off the toner remaining on the photoreceptor 1 as waste toner, the waste toner container 31 and a waste toner collecting rotary plate 32 for directing the waste toner to the waste toner container 31. The separator unit 4 contains a separation tape 42, a separation roller 40 and a pressure roller 41. The separation tape 42 is extended between the points A and B of the lower frame 6*b* via a spring 43 so that the upper surface of the tape is in contact with the trailing end surface of the photoreceptor 1. The separation roller 40 is in contact with the lower surface of the separation tape 42. The pressure roller 41 is forced by a spring 44 to press the separation roller 40 through the separation tape 42**.

Figure 4:
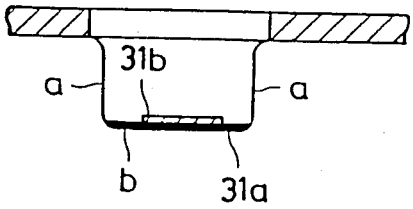
FIG. 4 shows the appearance of the flexible member when the container is not completely filled with waste toner.

The waste toner container 31 in the housing 6 has a recess 60 in its upper surface. A flexible member **31*a* made of a rubber film is provided in the recess 60. The flexible member 31*a* is of nearly cylindrical shape, comprising a thinner side wall "a" (See FIG. 4) and a thicker horizontal bottom "b" (See FIG. 4). A reflection plate 31*b* is provided on the external surface of the flexible member 31*a***.

A reflector 21 is mounted to the upper part of the cartridge 7 within the copying machine so as to cover the light source 10. The reflector 21 has a small slit **21*a* through which light from the light source 10 passes in the direction of the flexible member 31*a*. To the left of the reflector 21 is provided a sensor 22 for receiving the light reflected from the reflection plate 31*b*. The position of the sensor 22 is such that it cannot receive the light reflected by the reflection plate 31***b* when the flexible member 31*a* projects into the waste toner container 31 as shown in FIG. 1, but can receive the reflected light when the flexible member 31*a* projects outwardly from the container 31 as the container 31 is filled up with waste toner.

Figure 3:
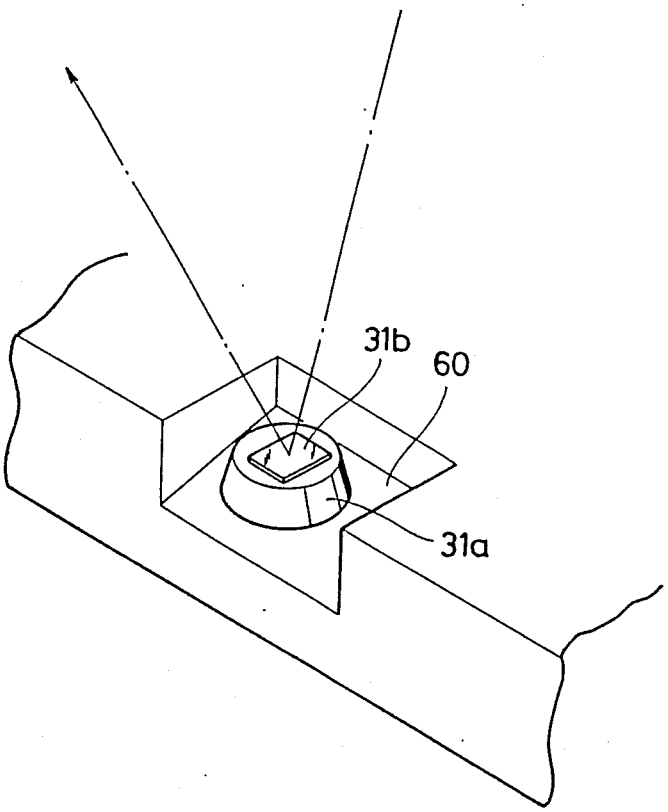
FIG. 3 shows the appearance of the flexible member when the container is filled with waste toner.

FIG. 3 shows the appearance of the resilient member 31*a* when the flexible member 31*a* projects outwardly from the container 31.

Figure 2:
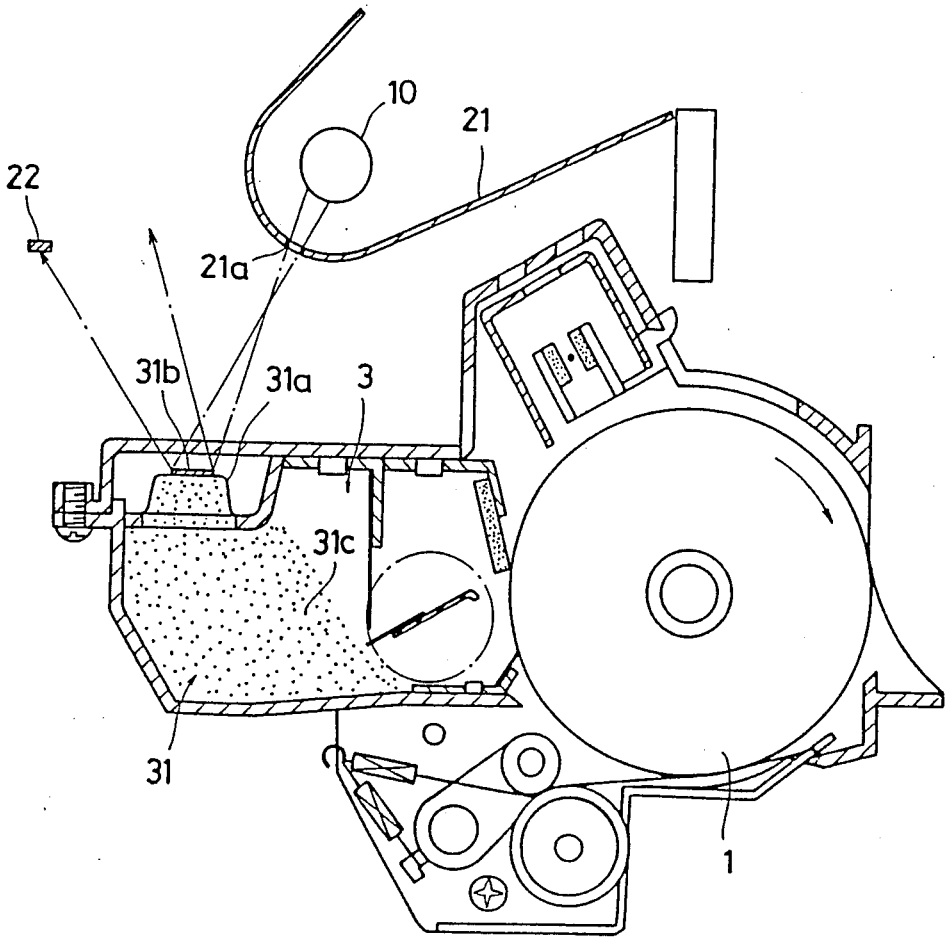

When the container 31 is not full, the flexible member 31*a* projects into the container 31. In this state, if the light coming through the slit 21*a* in the reflector 21 is reflected by the reflection plate 31*b* on the flexible member 31*a*, it is not sensed by the sensor. As the waste toner in the container 31 gradually increases it reaches a certain level, and the pressure of the waste toner against the horizontal bottom "b" of the flexible member 31*a* exceeds the force of the side wall "a" which makes the resilient member 31*a* project into the container. Then, due to the accumulation of the waste toner and increase of the waste toner pressure on the member 31*a*, the member 31*a* is caused to project outwardly from the container 31, as shown in FIG. 2. In this state, the light from the light source 10 passing through the slit 21*a* is reflected by the reflection plate 31*b* in the direction deviating to the left from the reflected light course indicated in FIG. 1, so that a part of the reflected light enters and actuates the sensor 22. Thus, the sensor 22 detects that the waste toner container 31 has been filled up with waste toner.

According to the present invention, as described above, the flexible member projects into the recess 60 or outwardly from the waste toner container, depending upon the pressure applied by the waste toner in the container. The amount of the change of the flexible member is large enough for the sensor to detect the full container very easily and accurately. Furthermore, since the flexible member is provided integrally with the cartridge, while the sensor and the light source are provided independent of the cartridge, the cartridge is very simple in construction and therefore produced at a low cost. In addition, since the light source installed for irradiating the document on the copying machine is also used as the light source for the detector, it is not necessary to install a separate light source, resulting in the simple construction of the entire copying machine. Another advantage of the present invention is that since the flexible member projects into the container when the container is not full, an operator can replace the cartridge without touching or causing other parts to touch the flexible member. This prevents the flexible member from being damaged or broken by an unexpected external force. The operability in handling the cartridge is also improved by the above feature of the present invention. The non-contact type sensor enhances the reliability of the detector.

While only certain embodiments of the present invention have been described, it will be apparent to those skilled in the art that various changes and modifications may be made therein without departing from the spirit and scope of the present invention as claimed.

What is claimed is:

1. A waste toner container for storing waste toner particles, inclusive of a system for detecting a full waste toner condition, comprising:

a waste toner container for collecting waste toner particles from a photoreceptor, said container having a recess formed in a corner of an upper surface thereof; and a flexible film member fixed in the bottom of said recess which projects into said container when said container is in an unfilled condition of said waste toner particles and is forced outwardly from said container due to pressure of said waste toner when said container is full of said waste toner particles, said member having a reflection plate mounted on an external surface of said flexible member.

2. The waste toner container detection system of claim 1, further including a light source for irradiating said reflection plate and a sensor provided in such a position as to receive light reflected by said reflection plate when said flexible member is projected outwardly from said container.

3. The waste toner container of claim 2, wherein said sensor comprises an optical sensor.

4. A copying machine, comprising:

a cartridge containing a photoreceptor, charger, cleaner unit, and separation unit, said cleaner unit including a waste toner container for collecting waste toner particles from a photoreceptor, said container having a recess formed in a corner of an upper surface thereof and a flexible film member fixed in the bottom of said recess which projects into said container when said container is in an unfilled condition of said waste toner particles and is forced outwardly from said container due to pressure of said waste toner when said container is full of said waste toner particles said member having a reflection plate mounted on an external surface of said flexible member; and a light source for irradiating a document on said copying machine, said cartridge being detachable from said copying machine.

5. The copying machine of claim 4, wherein said waste toner container detection system further includes a light source for irradiating said reflection plate and a sensor provided in such a position as to receive light reflected by said reflection plate when said flexile member is projected outwardly from said container.

6. The copying machine of claim 5, wherein said light source for irradiating said reflection plate is the one used for irradiating said document on said copying machine.

* * * * *